United States Patent [19]

Fischer

[11] Patent Number: 4,493,275

[45] Date of Patent: Jan. 15, 1985

[54] SEWING-MACHINE ATTACHMENT

[75] Inventor: Albert J. Fischer, Jewett City, Conn.

[73] Assignee: William Prym Werke KG, Stolberg/Rheinland, Fed. Rep. of Germany

[21] Appl. No.: 534,586

[22] Filed: Sep. 22, 1983

[51] Int. Cl.[3] ..... D05B 3/18

[52] U.S. Cl. ..... 112/105; 112/115

[58] Field of Search ..... 112/105, 106, 107, 104, 112/113, 115, 70, 77

[56] References Cited

U.S. PATENT DOCUMENTS

| | | | |
|---|---|---|---|
| 991,153 | 5/1911 | Holdaway | 112/115 |
| 1,294,927 | 2/1919 | McCann | 112/107 |
| 1,296,029 | 3/1919 | Wilson | 112/105 |
| 1,302,750 | 5/1919 | Ylioja | 112/115 |
| 1,354,794 | 10/1920 | Barron et al. | 112/105 |
| 2,295,851 | 9/1942 | Lee | 112/105 |
| 2,803,204 | 8/1957 | Alfandre | 112/105 |
| 3,123,032 | 3/1964 | Gehringer | 112/107 |

*Primary Examiner*—H. Hampton Hunter

*Attorney, Agent, or Firm*—Montague & Ross

[57] ABSTRACT

In order to facilitate the stitching of a finding such as a hook or an eye with two or three spaced-apart locations to an underlying fabric, an attachment for a sewing machine with a transversely oscillating needle or work table has a base on which a cross-slide assembly is mounted for supporting a retaining device movable in two mutually orthogonal directions under the control of a handle and a guide member displaceable along a part-circular track. The retaining device has a pointed stud engageable with the fabric and a gripper or clamping jaw adapted to hold the finding which, together with the fabric, is thus displaceable by the handle into any of three different positions relative to a stitching station aligned with the sewing machine.

13 Claims, 16 Drawing Figures

SEWING-MACHINE ATTACHMENT

FIELD OF THE INVENTION

My present invention relates to a sewing-machine attachment designed to facilitate the stitching of a workpiece referred to hereinafter as a finding, such as a garment hook or eye, to an underlying fabric at several spaced-apart locations.

BACKGROUND OF THE INVENTION

The sewing of garment hooks and eyes to a fabric generally requires at least two stitching operations, e.g. as described in U.S. Pat. Nos. 1,327,191 and 1,354,795. Jump stitches formed with the aid of a vertically reciprocating and horizontally oscillating upright needle may pass through adjacent perforations or across a leg of a hook body, for example, in a manner preventing any significant relative shift between the hook and the garment. A particularly secure positioning of such a hook can be achieved with 3-point fastening, the finding being provided for this purpose with three differently oriented formations suitably perforated to accommodate the stitches. With the needle oscillating in a single vertical plane, these formations must be so oriented that the threads holding them onto the fabric will lie in that plane during stitching; the necessary joint displacement of the hook and the fabric between stitching operations, relative to the mean needle position, ought to be as small as possible. The oscillations of the needle are relative to a work-supporting table which, in some instances, may swing horizontally while the needle moves only up and down on the stationary machine frame.

OBJECTS OF THE INVENTION

In a high-speed sewing machine, in which the operator cannot manually reorient the finding and the fabric between these stitching operations, means must be provided for automatically insuring the proper alignment of the finding with the needle in each working position. The general object of my invention, therefore, is to provide a sewing-machine attachment which satisfies this requirement for findings or workpieces to be fastened to a garment by 2-point or 3-point stitching.

A more particular object is to provide an attachment accommodating both hooks and eyes without requiring any adjustment on a switch from one type of finding to the other.

SUMMARY OF THE INVENTION

A sewing-machine attachment according to my invention comprises a base disposed at a fixed distance from a midposition of a vertically reciprocable upright needle about which the latter is oscillatable, relatively to an underlying work table, in a vertical plane; a support on this base is engageable with a fabric on the underlying work table and with a finding on that fabric—specifically a hook or an eye—to be stitched thereto at a plurality of spaced-apart locations lying on a common circle, this support being displaceable in a horizontal plane along an arcuate path including a like plurality of working positions in which respective formations of a finding engaged by the support are aligned with the midposition referred to for penetration by the needle. The support is limitedly movable, e.g. manually, with the aid of operating means coupled therewith by positively guided link means adapted to displace same parallel to itself along the aforementioned arcuate path.

Three working positions, which of course will always lie on a common circle, will be sufficient in most instances.

The displacement of the support parallel to itself along an arcuate path can be brought about by various means including, for example, a parallelogrammatic linkage. As more fully described hereinafter, however, I prefer to utilize link means comprising a cross-slide assembly that includes a first slide linearly displaceable on the base in one direction and a second slide linearly displaceable on the first slide in another direction transverse thereto. The second slide is rigid with the support and is connected with the operating means via a coupling member such as a vertical stem on a disk rotatable about a fixed vertical axis, this stem advantageously traversing an arcuate slot in a mounting plate forming part of the base. The disk may coact with indexing means for releasably retaining the stem in any of three working positions, two of them lying at opposite ends of the slot while the third one lies at a midpoint thereof. This third working position may be skipped when the finding or workpiece is to be fastened to the fabric at only two stitching points.

According to an advantageous embodiment, the base is pivotally mounted on a machine part coupled with the work table to swing about a horizontal axis lying in the aforementioned vertical plane, with the support carried on an outrigger arm so as to rest under its own weight on the underlying fabric.

BRIEF DESCRIPTION OF THE DRAWING

The above and other features of my invention will now be described in detail with reference to the accompanying drawing in which.

SPECIFIC DESCRIPTION

Figures 1, 1A, 6, 7, 8, 9:
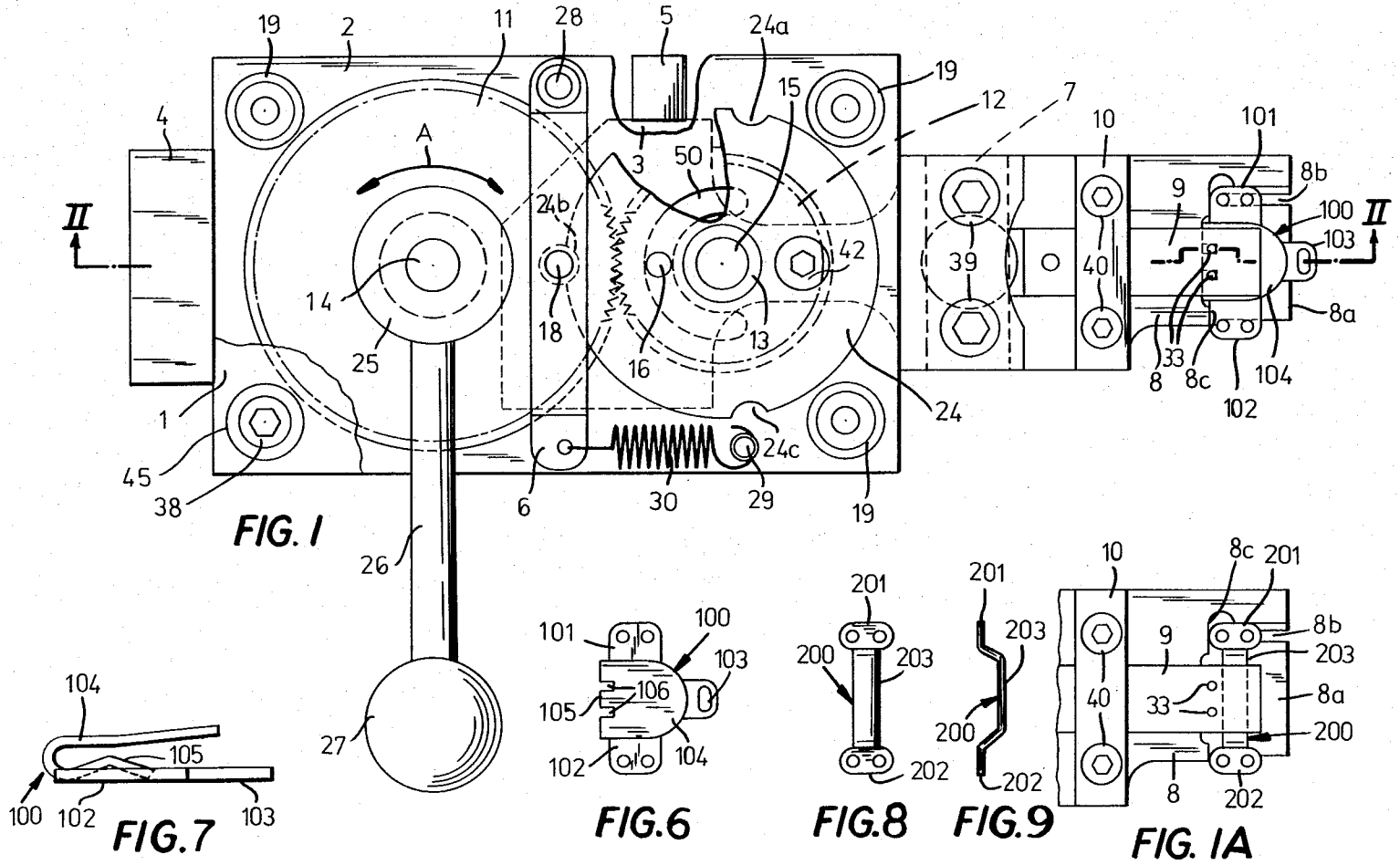
FIG. 1 is a top plan view illustrating a sewing-machine attachment according to a first embodiment of my invention, with parts broken away to show underlying structure, together with a garment hook supported thereon.
FIG. 1A shows part of the attachment of FIG. 1 supporting an eye complementary to the hook of FIG. 1.
FIG. 6 is a top view of the garment hook seen in FIG. 1.
FIG. 7 is a side view of the hook of FIG. 6.
FIG. 8 is a top view of the complementary eye seen in FIG. 1A.
FIG. 9 is a front view of the eye shown in FIG. 8.
Figure 2:
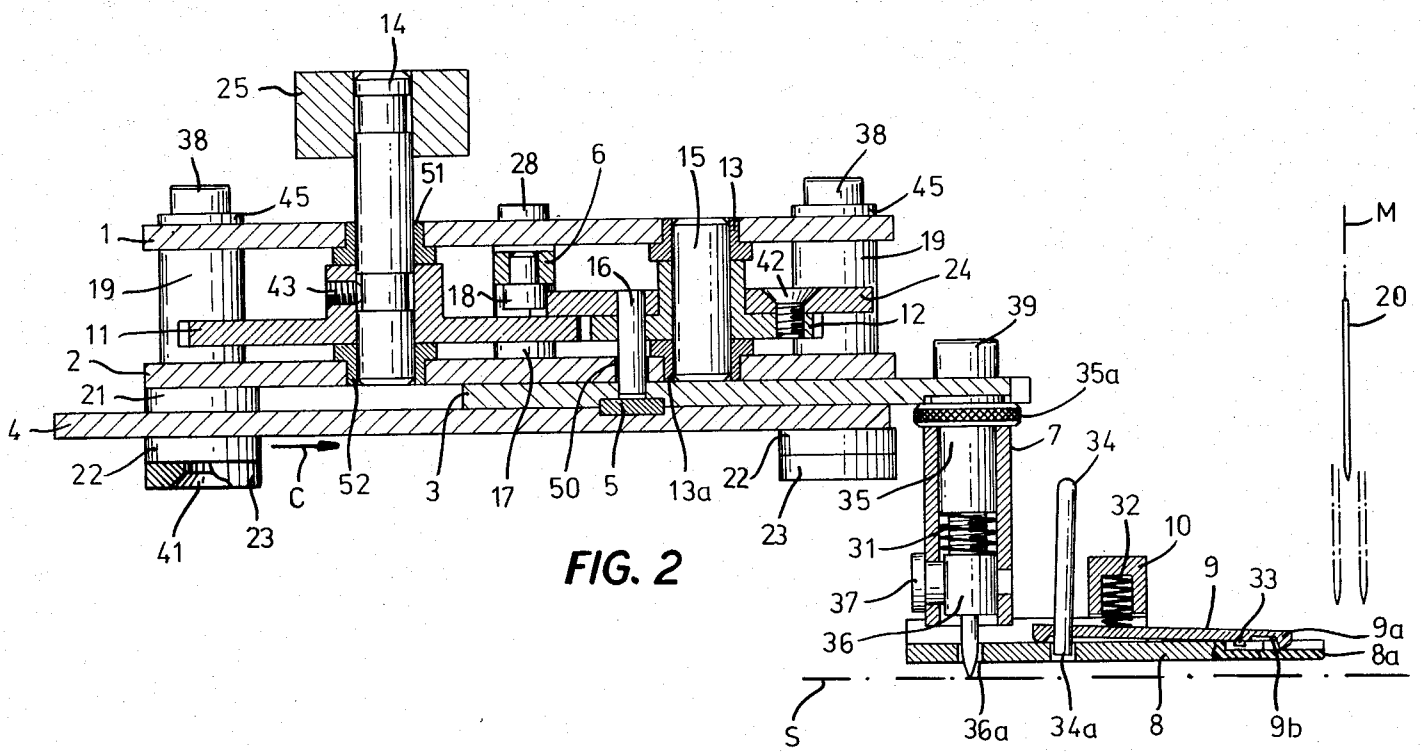
FIG. 2 is a cross-sectional view taken on the line II—II of FIG. 1.
Figure 3:
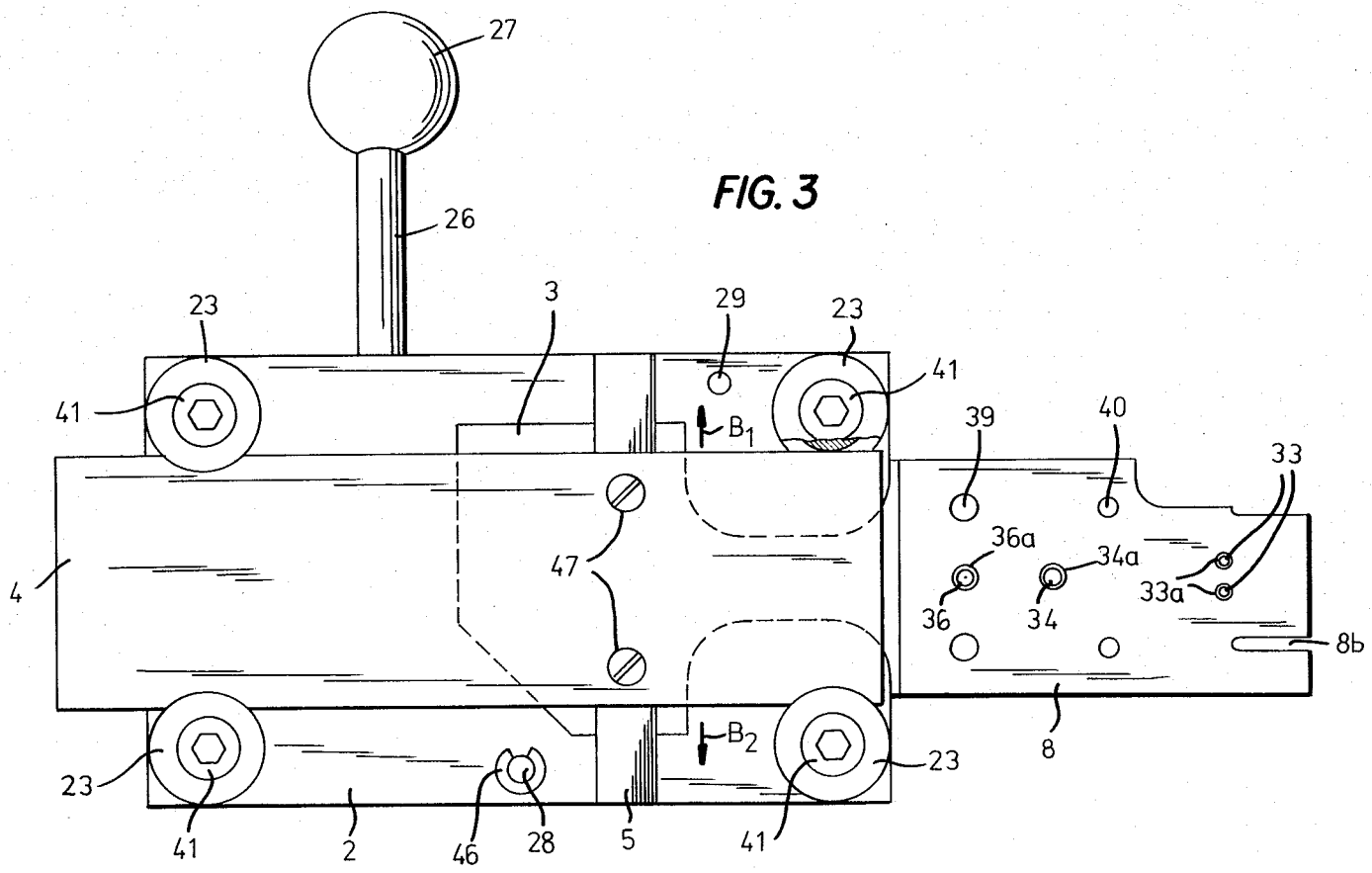
FIG. 3 is a bottom view of the attachment of FIGS. 1 and 2.
Figure 4:
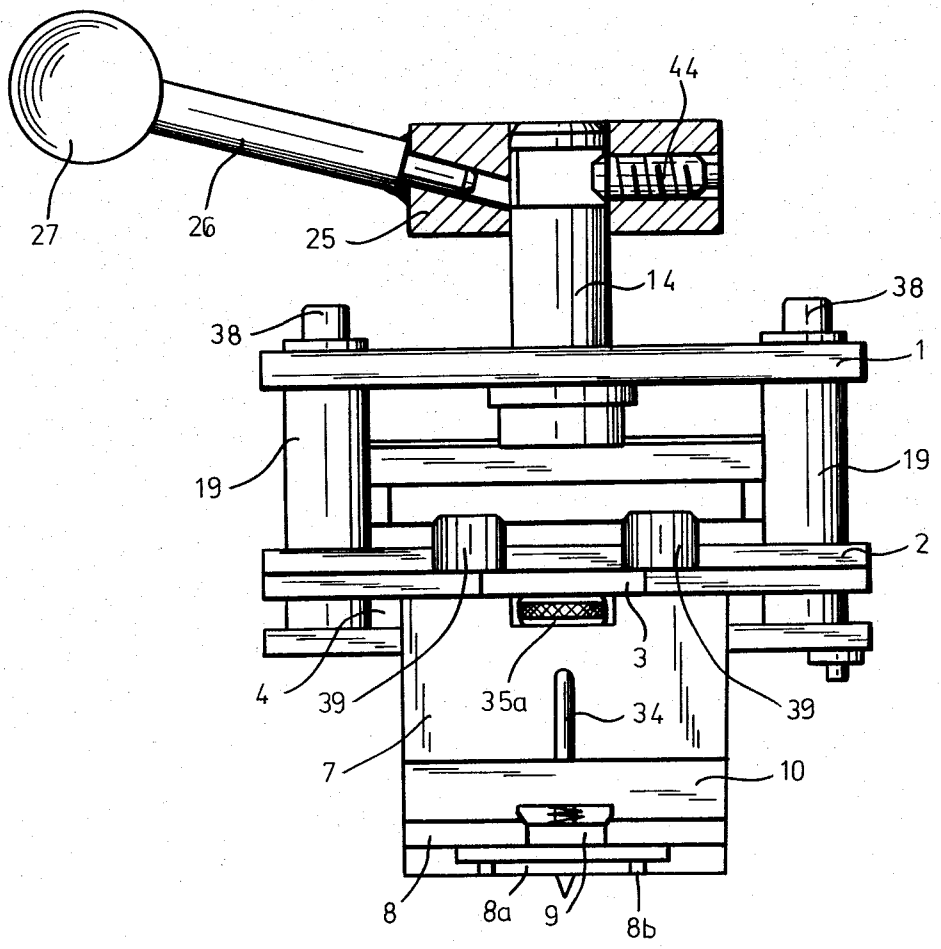
FIG. 4 is an end view as seen from the right in FIG. 1.

Reference will first be made to FIGS. 1–4 illustrating one embodiment of my invention. A conventional sewing machine, of which only a vertically reciprocable and transversely oscillatable needle 20 (as indicated in phantom lines) has been illustrated in FIG. 2, is provided with an attachment comprising a base fixedly disposed with reference to a midposition of the needle marked by a dot-dash line M in FIG. 2. The base comprises an upper plate 1 and a lower plate 2 spaced apart by four tubular corner posts 19, these corner posts being axially penetrated by threadedly interengaging screws 38 and 41 with socketed heads as seen in FIGS. 2 and 3. The heads of the lower screws 41 bear upon washers 23 which are separated from plate 2 by spacer rings 21 and bushings 22 leaving between them a gap for the guidance of a longitudinal slide 4, the latter being bracketed by the lower extremities of the four corner posts 19 so as to be linearly displaceable in the direction of the major edges of the rectangular plates 1 and 2.

A transverse sill 5 projecting from the upper surface of slide 4 guides a cross-slide 3 which thus is movable orthogonally to the direction of motion of slide 4 while projecting forwardly beyond the latter. The projecting end of slide 3 is rigid with a support in the form of a flat shelf 8 which lies below the level of base 1, 2 and is secured to slide 3 by means of a spacer block 7 with the aid of bolts 39 having socketed heads. A central bore of block 7 accommodates a pointed stud 36 with a head having a flattened face held against rotation by a plug 37, a threaded upward extension of this stud mating with a sleeve 35 which has an externally accessible knurled shoulder 35*a* whose manipulation enables the relative vertical position of the stud to be adjusted. A compression spring 31 surrounding the threaded extension of stud 36 eliminates tolerances between the mating threads of that extension and of the sleeve 35. The pointed end of stud 36 penetrates an aperture 36*a* in shelf 8 to pierce a fabric F (FIGS. 5A–5C) lying on an upper surface S of a work table, which forms part of the sewing machine, when the attachment is lowered onto the table. This table, along with the illustrated attachment, could oscillate in the longitudinal direction while needle 20 moves only vertically along the line M fixed with reference to a stationary part of the machine frame.

Shelf 8 has a forward extension 8*a* of reduced height forming a seat for a finding such as a hook 100 (FIG. 1) or an eye 200 (FIG. 1A) to be supported thereon. Diametrically opposite arms 101, 102 or 201, 202 of such a finding (see also FIGS. 6–9) each have a pair of perforations which in an inserted position overlie a linear slot 8*b* of seat 8*a* in the case of arm 101 or 201 while corresponding perforations of arm 102 or 202 lie just beyond the opposite edge of that seat. Hook 100 has a third arm 103 which projects endwise beyond seat 8*a* and has a perforation 103*a* (FIG. 5B); the latter, like perforations 101*a* (FIG. 5A) and 102*a* (FIG. 5C) of arms 101 and 102, stand clear of the seat in the illustrated insertion position so as to be readily penetrable by needle 20. In that insertion position, findings 100 and 200 come to rest against an edge 8*c* of shelf 8 while being held in place by a retaining member in the form of a clamping jaw 9 with a depending lip 9*a*; jaw 9 carries two locator pins 33 receivable, upon insertion of a hook 100 from the front (i.e. from the right as viewed in FIGS. 1–3), in incisions 106 (see FIG. 6) flanking a catch 105 which is integral with a resilient top shield 104 of the hook. Jaw 9 is further provided with a manipulating pin 34 which projects into an aperture 34*a* of shelf 8 and is swung counterclockwise (as viewed in FIG. 2) to raise the front end of that jaw against the force of a compression spring 32, received in a retaining block 10, when it is desired to release the hook or the eye from its seat. The pins 33 terminate above the upper surface of seat 8*a* to leave a clearance enabling a lateral insertion of an eye 200 (from below as viewed in FIG. 1) into the gripper 8, 9.

An operating member for the controlled displacement of workpiece support 8–10 comprises a shaft 14 which is journaled in plates 1 and 2 by means of bushings 51, 52 and is secured by a setscrew 43 to the hub of a driving gear 11 lodged between these bushings. The top of shaft 14 carries a ring 25, held in position by a setscrew 44, to which a handle 26 with a spherical knob 27 is attached. Gear 11 meshes with another, smaller gear 12 whose hub is bracketed by bushings 13 and 13*a* in plates 1 and 2, these bushings serving as bearings for a shaft 15. A disk 24, having peripheral notches 24*a*, 24*b* and 24*c*, is centered on shaft 15 and fastened to gear 12 by a screw 42; gear 12 and disk 24 are also secured to each other by a vertical stem 16 which projects down through an arcuate slot 50 of plate 2 into positive engagement with slide 3. Slot 50, centered on the axis of shaft 15, extends over an arc of somewhat more than 180° which corresponds to the arc of the peripheral zone of disk 24 encompassing the notches 24*a*–24*c*.

A bolt 28 traverses the plates 1 and 2, being held in position by a retaining ring 46 to act as a pivot for one end of a lever 6 which rests on a bushing 17 surrounding the lower part of that bolt. An indexing pin 18 carried on lever 6 bears upon the periphery of disk 24 under the biasing force of a tension spring 30 anchored to the free end of the lever and to a stud 29 bridging plates 1 and 2. Pin 18 serves for yieldably arresting the disk 24 in any of three working positions by engaging in a corresponding notch 24*a*, 24*b* or 24*c*; in the position illustrated in FIGS. 1–3, pin 18 rests in the middle notch 24*b* whereby stem 16 comes to lie midway along the arcuate slot 50. In the two limiting positions defined by notches 24*a* and 24*c*, stem 16 abuts respective ends of slot 50.

Figure 5C:
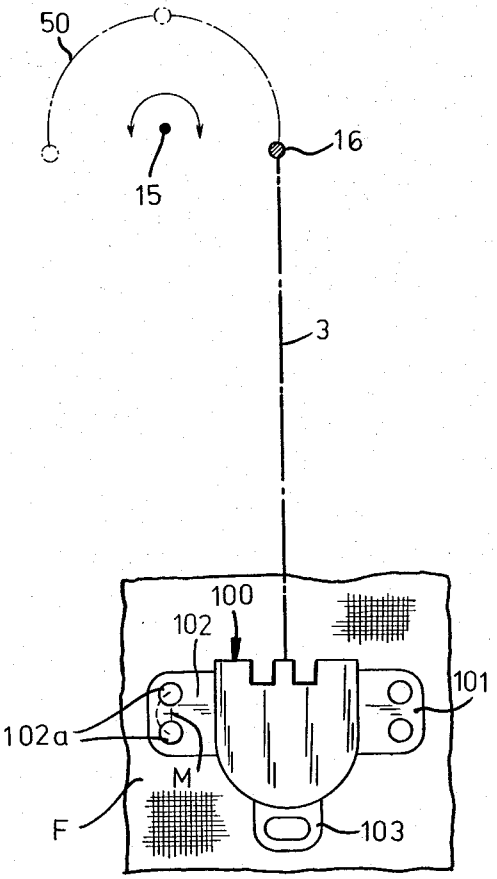
FIGS. 5A, 5B and 5C are diagrammatic views illustrating the mode of operation of the attachment shown in FIGS. 1–4.
Figure 5B:
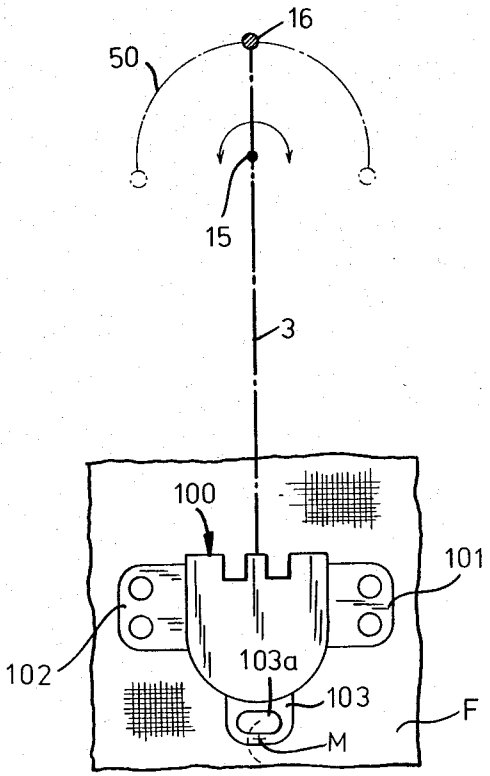
Figure 5A:
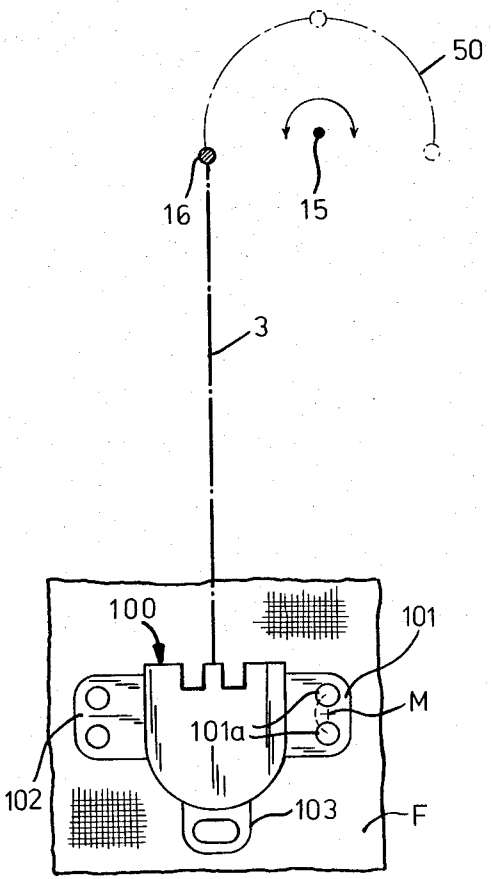

The step-up ratio between gears 11 and 12 enables the disk 24 to be rotated through its full range of more than 180° by a swinging of handle 26 through a considerably smaller angle, as indicated by an arrow A in FIG. 1. This rotation is translated by the slides, whose motions are indicated by arrows $B_1$, $B_2$ (FIG. 3) and C (FIG. 2), into an angularly coextensive displacement of workpiece seat 8*a* whereby arms 101, 102 and 103 of an inserted garment hook 100 can be successively aligned with the sewing needle 20. In FIGS. 5A–5C, where the slide 3, the shaft 15, the stem 16 and the slot 50 have been schematically represented, the relationship between the position of disk 24 and that of the engaged hook 100 has been made clear; these Figures also show that the midposition M of the needle is invariable with reference to the axis of shaft 15. Thus, FIG. 5A shows the stem 16 at the left-hand end of slot 50 (corresponding to engagement of indexing pin 18 in notch 24*a*) whereby the perforations 101*a* of hook arm 101 flank the mean needle position M so as to be alternately penetrated by the needle during an operation designed to stitch the arm 101 onto an underlying fabric F. In FIG.

5B the stem 16 lies in the middle of slot 50 (pin 18 coacting with notch 24b as in FIG. 1) whereby the perforation 103a of arm 103 lies close to needle position M so as to enable a stitching of this arm to the fabric F by threads passing across the outer rim of the perforation. FIG. 5C shows the other limiting position of stem 16 (with notch 24c engaged by pin 18) wherein perforations 102a of arm 102 flank the needle position M for a third stitching operation.

When the hook 100 is replaced by an eye 200 as seen in FIG. 1A, the arms 201 and 202 of that eye can be stitched to the fabric F in the positions of FIGS. 5A and 5C while the position of FIG. 5B is skipped. The jaw 9 will be seen in FIG. 2 to have an undercut 9b which accommodates the strap-shaped body 203 of this eye to hold it in the proper position.

As will be apparent from the foregoing description, the first stitching operation performed on any finding immobilizes the latter with reference to the fabric F which is simultaneously pierced by the pointed end of stud 36. Thus, the subsequent stitching operation or operations find the relative position of the fabric and the hook or eye virtually unchanged.

In FIGS. 10–13, in which elements corresponding to those of the preceding Figures have been identified by the same reference numerals, I have shown another embodiment differing in several respects from the one just described. Longitudinal slide 4, with a transverse sill 5' secured thereto by spring pins 69, is supported by a fixed base plate 60 replacing the bushings 22 and is laterally guided by three-point contact with two of four spacer rings 61, surrounding reduced lower extremities of corner posts 19', and with a dowel pin 62 rising from plate 60. Bottom plate 60 is held in place by buttonhead screws 41' threaded into posts 19' from below. The front end of top plate 1 carries a yoke 63, secured thereto by two of the four mounting screws 38' threaded into these posts from above, which has a horizontal bore 63a (FIG. 13) traversed by a pivot screw 64 (FIG. 11) that secures the entire attachment to a mounting member 70 with freedom to swing about the axis of screw 64; during a stitching operation, member 70 is fixed with reference to the work table represented by surface S in FIG. 2. The attachment is unsymmetrically weighted by an outrigger-type shelf 8' whose forward extension 8a', forming a seat for a finding 100 or 200, is thus able to bear by gravity upon an underlying piece of fabric to which such finding is to be stitched. The underside of shelf extension 8a', formed with a needle-receiving slot 8b', is knurled or otherwise roughened to hold the fabric in place without the need for additional retaining means such as the stud 36 of the preceding embodiment.

Figure 12:
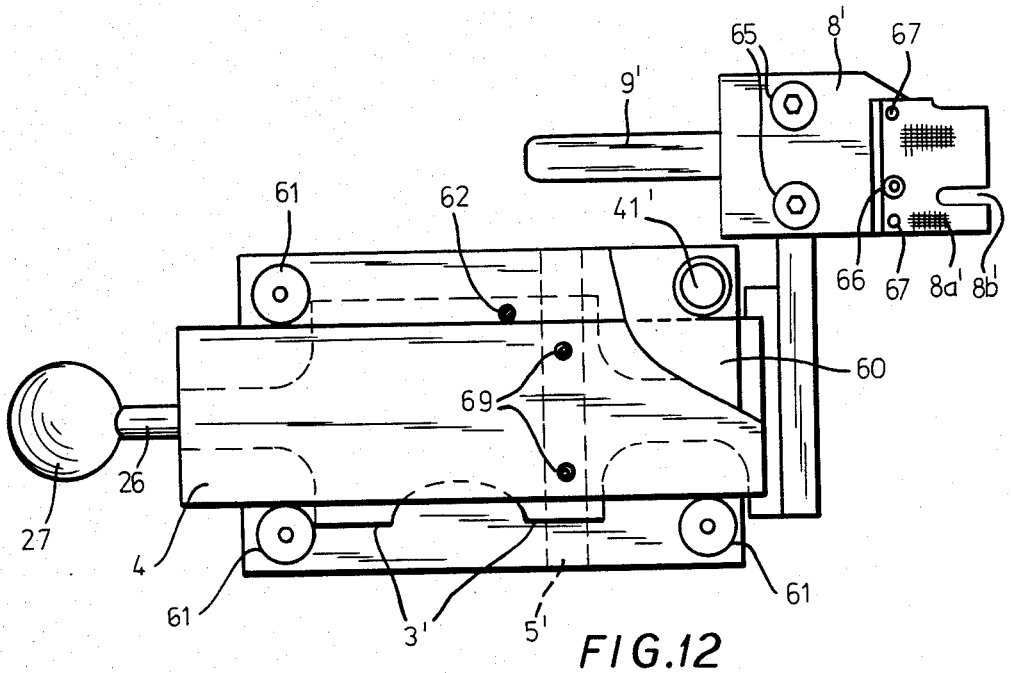
FIG. 12 is a bottom view of the attachment of FIGS. 10 and 11, with a bottom plate thereof partly broken away.
Figure 13:
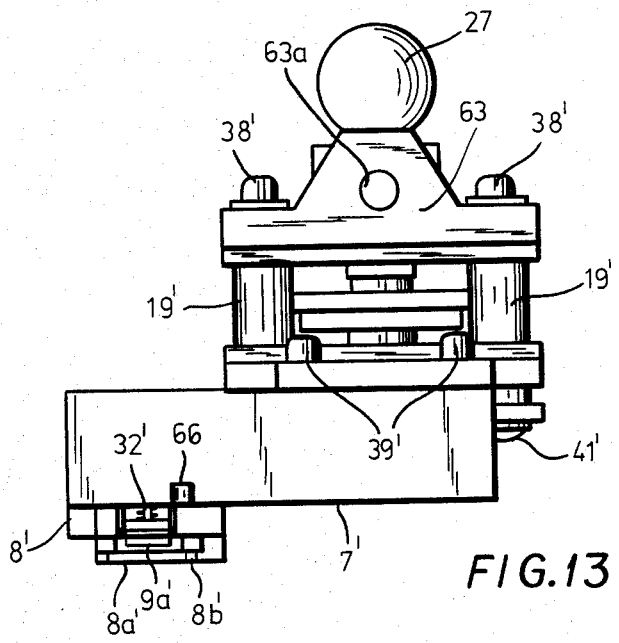
FIG. 13 is an end view as seen from the right in FIG. 10.

A modified cross-slide 3', guided transversely by sill 5', has its front end attached by bolts 39' to a connecting bar 7' to whose outlying end the shelf 8' is attached by countersunk screws 65 seen in FIG. 12. A cap screw 66 and two dowel pins 67 secure the seat 8a' to shelf 8'. A similar pin 68, rising from shelf 8' rearwardly of bar 32', penetrates with slight play an overlying clamping jaw 9' in the form of a flat strip which has an angled front end 9a' holding an inserted finding in position under pressure of a spring 32' lodged in a vertical bore of bar 32'. The opposite end of jaw 9' projects well beyond the rear edge of shelf 8' so as to be lowerable by finger pressure to facilitate the lateral insertion of an eye 200, as indicated in FIG. 10; clamp extremity 9a' yields readily to the frontal insertion of a hook 100 (FIG. 6).

Figure 10:
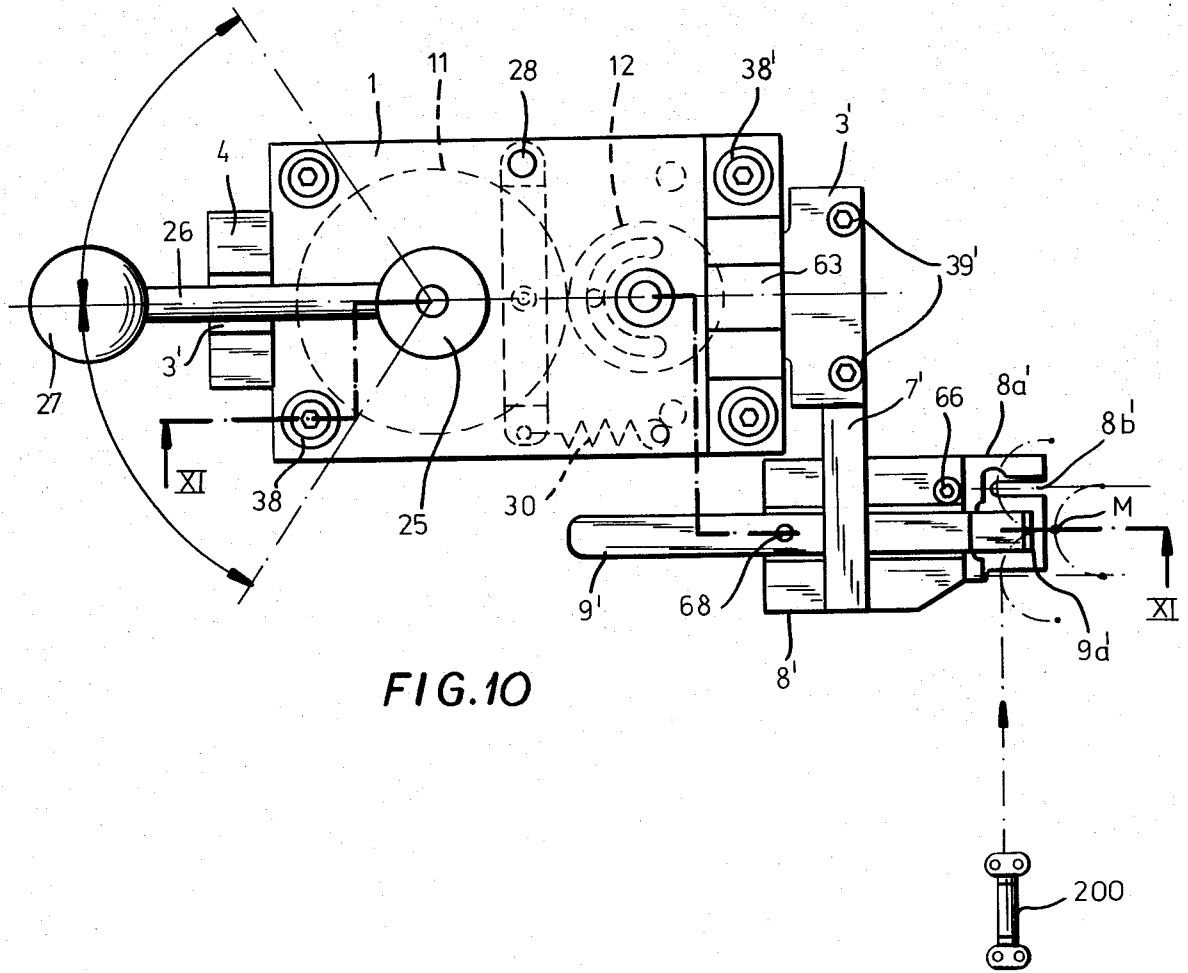
FIG. 10 is a top plan view of a modified attachment representing a second embodiment, drawn to a smaller scale than FIG. 1.
Figure 11:
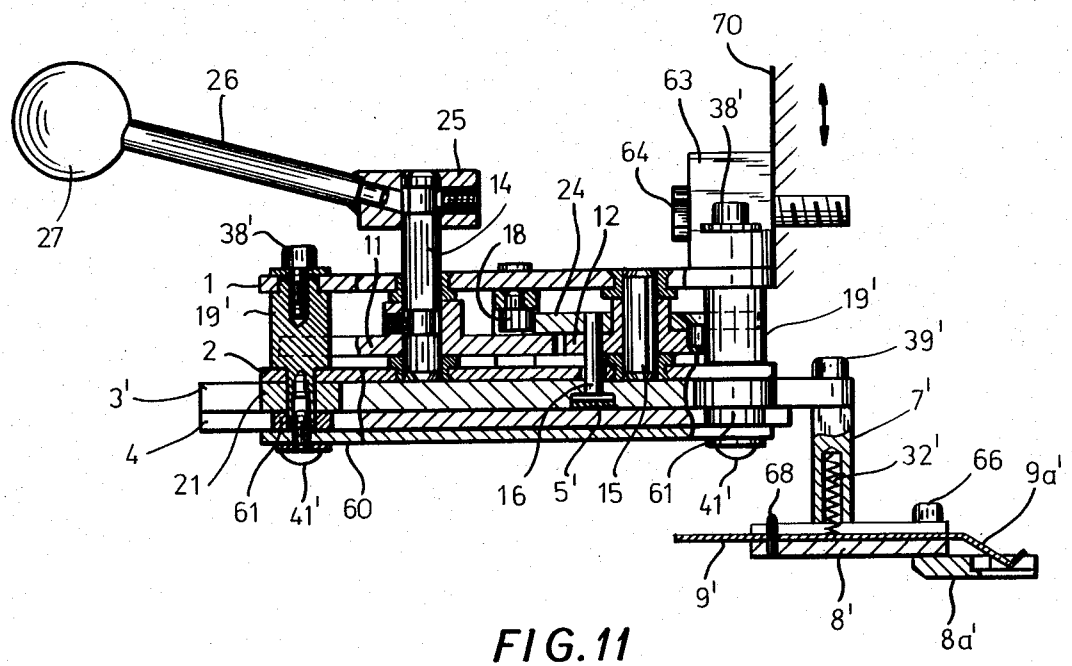
FIG. 11 is a cross-sectional view taken on the line XI—XI of FIG. 10.

Three circular arcs of somewhat more than 180°, shown in dot-dash lines in FIG. 10, represent the motion of three critical points of an inserted hook (corresponding to the locations marked M in FIGS. 5A–5C) during a swing of handle 26 to either side from its illustrated midposition which in this embodiment is in line with the longitudinal direction of the attachment rather than transverse thereto as in FIGS. 1–4. The operation is otherwise the same in the two instances.

The attachment-supporting member 70 could be horizontally oscillatable together with the work table, as discussed above, if the needle 20 (FIG. 2) were only vertically reciprocable on the machine frame. In any event, the coupling of this member with the work table ought to allow for a manual raising and lowering of the attachment relative to the table surface, as indicated by an arrow in FIG. 11.

I claim:

1. An attachment for a sewing machine provided with a vertically reciprocable upright needle that is limitedly oscillatable in a vertical plane, relatively to a work table, about a midposition above said work table, comprising:

a base disposed at a fixed distance from said midposition;

a support on said base engageable with a fabric on said work table and with a finding on said fabric to be stitched thereto at a plurality of spaced-apart locations lying on a common circle, said support being displaceable in a horizontal plane along an arcuate path including a like plurality of working positions in which respective formations of a finding engaged by said support are aligned with said midposition for penetration by said needle; and operating means coupled with said support by positively guided link means for displacing same parallel to itself along said path.

2. An attachment as defined in claim 1 wherein said support comprises gripper means engageable with a finding and a pointed stud adjacent said gripper means engageable with an underlying fabric.

3. An attachment as defined in claim 2 wherein said gripper means comprises a shelf and a retaining member adapted to hold a finding onto said shelf with said formations laterally projecting therefrom.

4. An attachment as defined in claim 3 wherein said retaining member has at least one locator pin engageable with an incision of an engaged finding.

5. An attachment as defined in claim 1 wherein said link means comprises a first slide linearly displaceable on said base in one direction, a second slide linearly displaceable on said first slide in another direction transverse to said one direction, and a coupling member connecting said second slide with said operating means, said support being rigid with said second slide.

6. An attachment as defined in claim 5 wherein said operating means comprises a disk rotatable about a fixed vertical axis, said coupling member being a vertical stem eccentrically mounted on said disk.

7. An attachment as defined in claim 6 wherein said base has a mounting plate formed with an arcuate slot traversed by said stem and centered on said axis.

8. An attachment as defined in claim 7, further comprising indexing means coacting with said disk for releasably retaining said stem in any of three working positions, said stem lying at opposite ends of said slot in two of said working positions and at a midpoint of said slot in the third working position.

9. An attachment as defined in claim 8 wherein said slot extends over at least 180°.

10. An attachment as defined in claim 5 wherein said base is pivotally mounted on a member coupled with said work table for swinging about a horizontal axis, said support being offset from said axis and connected with said second slide by an outrigger arm for coming to rest on an underlying fabric by gravity.

11. An attachment as defined in claim 10 wherein said axis lies in said vertical plane.

12. An attachment as defined in claim 10 wherein said support has a roughened underside engageable with the underlying fabric for holding same in position on said work table.

13. An attachment as defined in claim 12 wherein said support comprises a shelf and yieldable clamping means for holding a finding onto said shelf with said formations laterally projecting therefrom.

* * * * *